United States Patent [19]

Titus

[11] 4,123,174

[45] Oct. 31, 1978

[54] MIXER

[76] Inventor: Hans-Joachim Titus, Katzenpfad 4, 6148 Heppenheim, Germany

[21] Appl. No.: 807,548

[22] Filed: Jun. 17, 1977

[30] Foreign Application Priority Data

Jun. 18, 1976 [DE] Fed. Rep. of Germany ..... 2627259

[51] Int. Cl.[2] ..... B01F 7/00; B01F 13/02

[52] U.S. Cl. ..... 366/102; 366/193; 366/287; 366/318

[58] Field of Search ..... 259/5, 21, 40, 64, 102, 259/111, DIG. 16

[56] References Cited

U.S. PATENT DOCUMENTS 2,967,695 1/1961 Nauta ..... 259/102

FOREIGN PATENT DOCUMENTS 2,336,104 2/1975 Fed. Rep. of Germany ..... 259/102
1,583,977 12/1969 France ..... 259/111
911,557 11/1962 United Kingdom ..... 259/DIG. 16

*Primary Examiner*—Philip R. Coe
*Attorney, Agent, or Firm*—Bacon & Thomas

[57] ABSTRACT

A mixer is disclosed of the type including a downwardly tapering conical wall and a rotating worm or screw which rotates both about its own axis and which rotates about a conical path along the inside wall of the vessel to effect mixing. At the bottom of the vessel is a flanged opening, and a bearing housing sealingly engages the flanged opening of the mixing vessel from below. The bearing housing includes a product outlet tube extending straight vertically downwardly therefrom.

9 Claims, 4 Drawing Figures

MIXER

The invention concerns a mixer for powdery or coarse-grained loose material. It consists of a conic mixing vessel with a product feeder located on top, a product discharge on the bottom, and a mixing worm or screw mounted between the vessel's bottom and the filling level. The axis of the mixing screw is provided, in addition to its own intrinsic rotation, with a circular motion along the vessel's wall.

Such mixers are already known and are used, for example, in the pharmaceutical industry in order to achieve a variety of product components with high homogeneity, or to initiate a chemical reaction. The conical mixing tank, coupled with a driven screw, serves to insure an intensive mixing process, in which the product is transferred upwards from the vessel's bottom and, in addition, is moved longitudinally along the vessel's wall. In these designs, the upper end of the screw is carried by a swivel arm which is mounted at the vessel's cover.

In another known design version, the upper swivel arm is directly given a rotary motion and, additionally, a rotary drive provided for the worm conveyer is either overhung mounted along the swivel arm or is supported along its lower end on the tank's floor. In case of products which are not easily mixable, it is also known that the upper worm ends are provided with cycloidal or trochoidal motions. For this purpose the swivel arm is divided into articulate segments and the two partial arms are propelled at different speeds and/or in different rotary directions. Such drives cannot be sealed with a high degree of reliability and they often endanger the expensive pharmaceutical products, which in case of a breakdown are either totally destroyed or made unusable inside the mixing vessel. Also, greaseless knuckle joints and other coupling devices are not suitable in cases of high purity requirements encountered, for example, in the pharmaceutical industry. The reason is that the intense stresses encountered in the mixing process lead to abrasions which contaminate the product. On the other hand, the problem of sealing off a worm shaft that is led into the mixing vessel from below is unsurmountable in respect to locating a product outlet without causing a dead zone of unmixed material.

The object of the invention is to create an improved mixer of the kind described above, in which no drive joints or drive bypasses come into contact with the mixed product. Further, a simplified overall construction in which all dead zones are avoided in the mixing process, and in which a complete discharge of the mixing vessel is guaranteed. In this invention, this is accomplished in that the worm shaft which enters the mixing tank from below is mounted, along its lower end, in a sealed housing. This housing is located along the lower flange of the mixing tank. A product outlet tube emerges from this housing in a downward direction. This outlet tube can be rotated around a horizontal axis by means of a driven support.

This concept leads to a new mixer in which the self-contained drive of the worm gear and the drive that produces the worm's rotary or cycloidal motion is produced outside the mixer proper. This allows for an effective seal and assures a sterile environment even in case of continuous operation. By avoiding any mountings inside the product area, the end products which are often very sensitive, remain without impurities and thus assuring the particle purity that is specified or demanded by the chemical industry. In addition, a product area is obtained which is unaffected by the mixing effect of the worm gear. The vertical product outlet tube assures that the product completely exits from the vessel; it passes vertically downwards through the mixing unit by reversing the drive of the conveyer worm. In existing designs equipped with lateral product outlet openings, the product will become compressed downwards against the vessel's floor causing an overload of the worm drive. The drive comes to a stop and, at the same time, the product compression would act against the worm shaft's opening and destroy the seal at this point.

In order to give the mixing worm a circular motion, it is possible to support the housing mount of the lower end of the worm shaft by means of a ring shaped worm gear. This support structure, in turn, is supported by a bearing housing located on the bottom of the mixing vessel. In this case, the housing extends through the worm gear and is supported or connected. to projections along the worm gear.

Even though the basic idea of the invention can provide for a rigid connection between the ring shaped supporting structure and the bearing housing which carries the lower end of the worm shaft, it is necessary that the housing be supported by means of horizontal bearing pins, which extend from the projections of the supporting structure. These bearing pins form a common horizontal rotation axis for the housing, so that the same mixing drive motor can be attached to the mixing tank with varying conical angles. Furthermore, a certain titling or swivelling motion is necessary in cases of larger mixing worm shafts; as for example when the length exceeds 4 meters. In that case, an outer support in the form of an upper guide beam must be provided. In cases of larger dimensioned mixing vessels, the mount of the guide beam can not be absolutely centered — at reasonable costs — so that structural tolerances must be taken into account in respect to the tilting or swivelling characteristic of the housing.

The housing's seal is obtained by way of a spherical surface, which rests against two concentric slide ring packings. The packing rings are pressed against the sperical surface and the ring space between the packings is filled with an inert gas whose pressure can be monitored by means of a manometer.

In case of a taper bore mounting of the mixing worm, the articulated support of the housing on the bearing pins would not be necessary. However, this design has been retained in order to insure uniform construction in the production run. In any event, in this case, the top of the housing is provided with a vertical slide ring surface instead of the sperical surface. By this means, the housing is connected with a slide ring that is located on the bottom of the mixing vessel. The seal of the housing is assured by means of a ring surface facing upwards, against which two concentric slide rings with an intervening blocking gas chamber are placed from above.

The rotary drive for the circular movement of the mixing worm can also be mounted along the exterior surface of the mixing vessel. In this case, there will extend from the worm gear, or from a suitable structural part, projections for supporting the housing. The projections, in turn, are provided with trunnions for the pivotable mounting of the housing.

Because of the bottom drive and the bottom mounting of the mixing worm, the upper side of the mixing vessel remains free and uncluttered. This suggests that the mixing vessel itself should serve as storage bunker and to expand its function so that in place of a tank cover, a cyclone separator in form of a cylindrical casing with a tangential inlet be provided on top, in which, preferably, in terms of this invention, a filter element is installed which is surrounded by a rectangular immersion tube. This forces the gas stream that is generated in the cyclone separator to distribute uniformly around the circumference of the immersion tube and assures that the gas stream carrying the enriched product sediment enters the filter from below.

This combination or arrangement would be meaningfully amplified, if, by a hollow mixing worm, nitrogen gas would be supplied in order to liberate the product from the odor which stems from the solvent. The purifying gas is introduced into the product by way of openings in the worm shaft, or by way of porous material along the rear side of the worm blade. In the same fashion, it is possible to introduce cooling gas into the product. The overall construction can be integrated into a complete chemical plant in which the product is handled starting with a filtering centrifuge and ending with the sterile bagging of the product and with due consideration given ecological requirements. Until now, cyclone separators were used for separating sulfur from gas streams in which the separated product dropped into containers. This was followed by a dust filter process which was needed to satisfy the legal code governing exhaust gas purities. In case of this invention, this equipment is combined into one apparatus which serves, at the same time, for product mixing.

Further advantages and characteristics of the invention can be seen from this description and illustrations. Thus:

Figure 1:
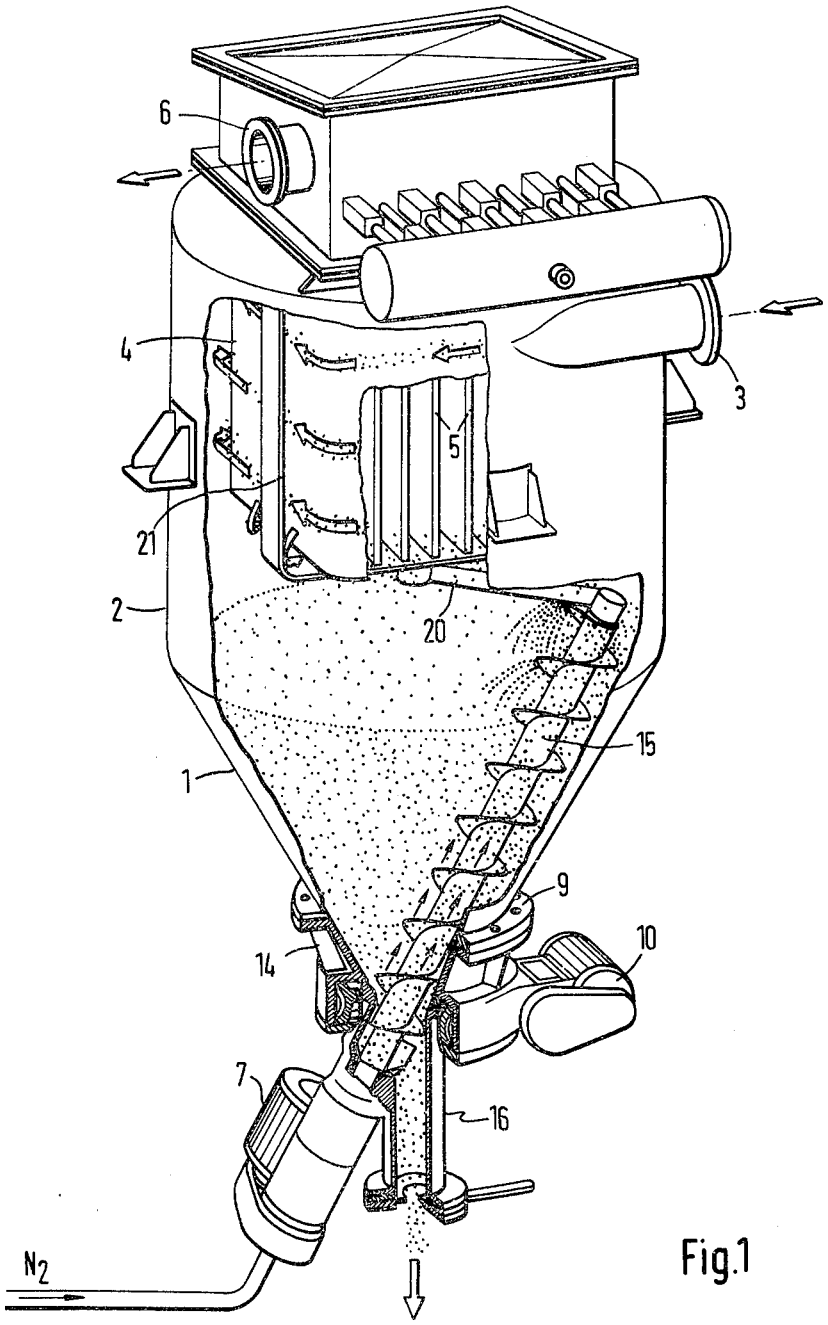
FIG. 1 is a schematic view of a mixer coupled with a cyclone and filter.

FIG. 1 shows a conic mixing vessel 1 on which the cylindrical casing 2 of a cyclone separator is mounted and which is provided with a tangential inlet 3. Into this bunker unit, consisting of mixing vessel and casing tube, a pocket filter or tube filter 5 is concentrically arranged, which, in turn, is surrounded by an immersion tube 4. The latter can be round or multi-sided. The gas which is purified in this filter exits through an upper clean-gas chamber via the connecting stud 6.

The mixing worm 15 can be driven during the separation process. As shown in FIG. 1, this worm gear executes, by means of the guide 20, a circular motion along the wall of the mixing vessel. The guide 20 is mounted in a manner that allows for rotation by means of a clamp 21, below the filter 5. These support points, which are not subjected to any special stresses, can be made of so called "fiber glass bushings" made of anti-abration, anti-friction, reinforced fiberglass.

Figure 4:
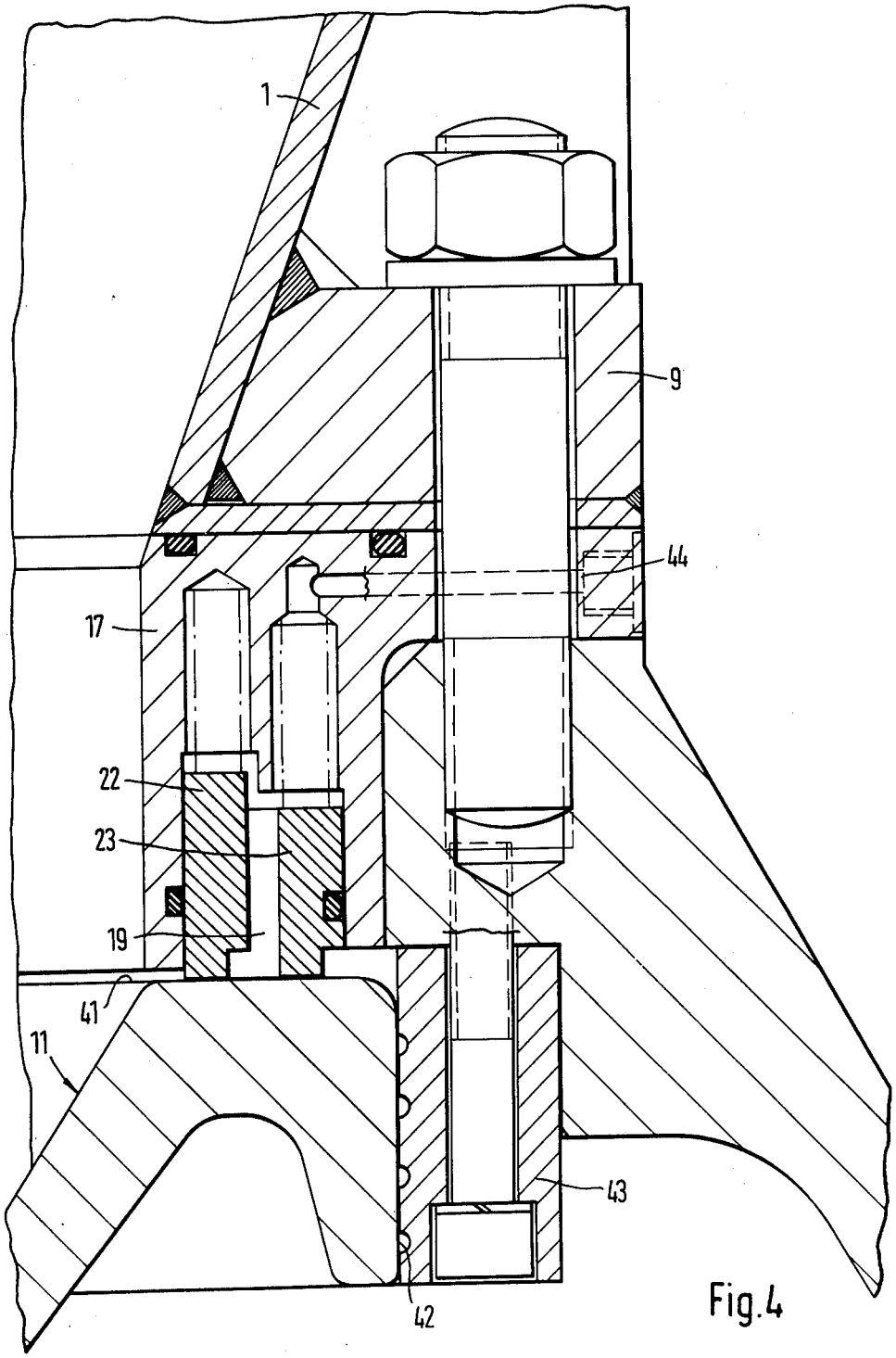
FIG. 4 is an enlarged partial cut through the area of the seal and mounting of the driving unit.

The mixing worm 15 can also be taper bore mounted, so that it is only carried on one end by two, spread, posts 38. It is possible to provide an additional mount as shown in FIG. 4. By means of an eccentric arrangement of the supports of the guide beam 20, it is possible to generate cycloidal tracks or motion of the mixing worm. For this purpose, the guide beam can be telescopically shortened by means of an encapsuled pneumatic cylinder or any number of other ways.

Figure 2:
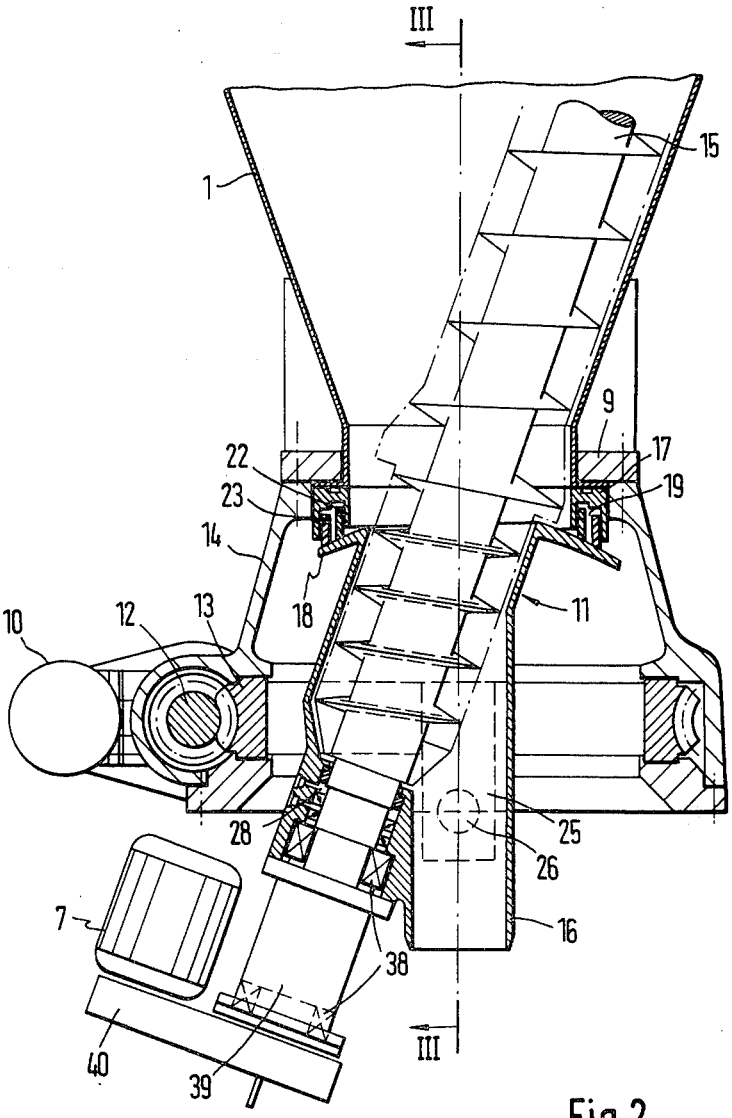
FIG. 2 is a cross section of lower part of mixer.
Figure 3:
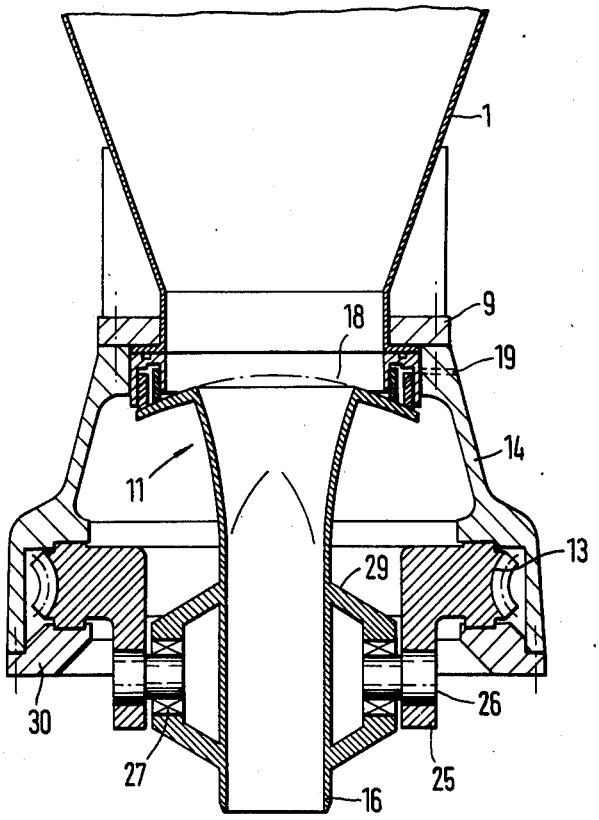
FIG. 3 is a cross section through line III—III in FIG. 2.

FIGS. 2 and 3 depict the mixing vessel with a carrier housing 14 attached to a flange 9. A ring shaped worm gear is mounted in the carrier housing. The center axis of the worm gear corresponds to the vessel's own axis. Along the carrier housing, a drive motor 10 is attached which drives the worm 12 by way of a chain drive. The worm 12 engages the worm gear 13. The worm gear carries two projections 25 with holes for the bearing pin 26 which defines the horizontal axis of rotation for the bearing housing 11 and the mixing worm 15.

The bearing housing 11 is provided with a Y shape and surrounds two tubular legs. At the end of one tubular leg, the mixing worm 15 is mounted at point 38. A drive motor 7 for the mixing worm is connected to the housing 11 by means of a flanged bearing cage 39 and a drive housing 40.

Inside the bearing housing 11 is located the mixing worm which is sealed off at 38 by means of slide ring packings and a blocking gas chamber. Thus the product is protected against impurities. The bearing housing is also provided with a vertical product exit tube 16. This allows for the complete evacuation of the mixing vessel 1 by simply reversing the conveyer direction of the mixing worm 15 and without any additional equipment; a slide, which is not shown, need only be opened. The quantity of the product that entered the outlet 16 during the mixing process, can, if needed, by drawn off and re-introduced into the mixing vessel from above. As shown in FIG. 2, the worm blades located above the bearing housing 11, can be easily enlarged to match the opening stud of the mixing vessel and thus prevent the formation of dead zones.

The upper part of the bearing housing 11 is surrounded by outlet openings having spherical surfaces 18. They are of high surface quality. Two concentric slide rings 22, 23, made, for example of Teflon-sintered fabric are provided. Between the packing rings is the empty space 19, which acts as a blocking gas chamber. For this purpose, an inert gas is used, whose pressure is contantly controlled. The arrangement consisting of the packing rings 22, 23 and springs is located inside the inert 17 along the carrier housing 14. It serves to seal off the ring flange 9.

In a preferred design version, the pivot angle of the bearing housing 11 which is supported with the mounts 27 on the stud 26, amounts to approximately 5°. This angle can be greater. This pivot angle is required when larger worms are needed which require counter mountings for the guide beam 20. It is practically impossible to mount the guide beam 20 exactly concentrically inside the mixing vessel's axis. The pivotabiliy of the bearing housing, is, however, also necessary for special mixing movements of the mixing worm 15.

In the preferred design form illustrated in FIG. 4, the mixing worm 15 is taper bore mounted along the bearing housing 11. Along the upper end of the bearing housing 11, a horizontal sealing surface 41 and an externally vertical ring surface 42 is provided in place of the spherical surface 18. The sealing surfaces are supported and connected with the bearing housing via a slide packing ring 43. This slide packing ring 43 is attached in an insert of the carrier housing 14, so that the forces of the mixing worm 15 acting on the bearing 38 of the bearing housing 11, are supported by the slide packing ring 43. Additional support is provided by the bearing pin 26 or by a rigid connection between the drive ring 13 and the bearing housing 11.

The ring surface 41 is preferably provided with a specially hardened and porous-free surface layer. For example, with a nickel alloy such as the commercially available "Colmoloy". The slide rings 22, 23 can be made from high grade steel. The insert 17 forms a sealed connection between the carrier housing 14 and the lower flange 9 of the mixing vessel 1. This insert encloses a channel 44 for the inert gas that is led into the blocking gas chamber 19.

The mixing worm 15 is driven by the motor 10 at an angle of about 400° and then pivots back again. This is due to the fact that the connections to the motors 7 and 10, as well as the connections for the $N_2$ supply in FIG. 1, consists of rubber tubes. By means of the lower connection shown in FIG. 1, inert gas is admitted into the hollow shaft of the mixing worm 15. The gas enters into the product area by way of the sinter metal sheet along the rear side of the worm blade. Depending on existing requirements, the lower blades of the mixing worm are hollow with a high grade steel sheet at the front side while the sinter metal is placed at an acute angle to form the rear side of the worm blade. As a result, a triangular shaped hollow space is formed into which is admitted the inert gas from the hollow shaft. In place of the combination shown in FIG. 1, it is possible for the top of the mixing vessel 1 to be sealed off by any kind of cover or access hatch which is provided with an inlet or feed nozzle.

I claim:

1. A mixer, comprising:

(a) a mixing vessel with one end larger than the other, at least part of said mixing vessel having a wall of conical configuration, the larger end facing upwardly, the other end being a bottom end, said mixing vessel including a vertical axis;

(b) product outlet means in said vessel adjacent the bottom end thereof;

(c) a mixing worm in said vessel, said mixing worm having a longitudinal axis;

(d) means for rotating said mixing worm about said longitudinal axis;

(e) means for driving said mixing worm such that said axis thereof moves in a circular motion along said vessel wall of conical configuration;

(f) said mixing worm being so disposed as to enter said mixing vessel from said bottom end of said vessel;

(g) a flanged opening in said vessel adjacent said product outlet;

(h) a bearing housing sealingly engaging said flanged opening of the mixing vessel from below;

(i) said bearing housing having a downwardly extending product outlet tube; and (j) a rotatively driven mount which turns around the vertical axis of said vessel, said mount supporting said bearing housing.

2. A mixer in accordance with claim 1 including a carrier housing connected to said mixing vessel; a ring shaped worm gear in said carrier housing; said bearing housing being concentrically supported inside said ring shaped worm gear.

3. A mixer in accordance with claim 2 wherein said worm gear includes projections thereon and wherein horizontal mounting studs are attached to said projections, said bearing housing being pivotally mounted in worm gear by said mounting studs.

4. A mixer in accordance with claim 3 including a stationary sliding ring mounted to said carrier housing, said bearing housing having an upper end, said upper end of said bearing housing having a mounting surface thereon, which mounting surface is concentric with said vertical axis of said vessel, said mounting surface being guided by said stationary ring.

5. A mixer in accordance with claim 4 wherein said bearing housing has an upper horizontal seal surface, wherein two concentric slide packing rings sealingly engage said horizontal seal surface, said slide packing rings defining an intermediary blocking gas chamber.

6. A mixer as defined in claim 1 wherein said bearing housing has a "Y" configuration at least partially defined by first and second tubular legs, said mixing worm being mounted in said first tubular leg, said first tubular leg being sloped with respect to said vertical axis of said vessel, said second tubular leg defining said product outlet tube, said second tubular leg being aligned with said vertical axis of said vessel.

7. A mixer in accordance with claim 6 wherein said bearing housing has an upper part with a spherical surface, wherein said flanged opening includes a flange with a lower side, wherein reinforced concentric packing rings are pressed against said spherical surface below said flanged opening, said packing rings defining a blocking chamber, said blocking chamber being filled with pressurized inert gas.

8. A mixer in accordance with claim 7 wherein said bearing housing is mounted for pivoting through an angle of at least 5%, and wherein an arresting device is operatively coupled with said mixing worm to limit angular movement thereof.

9. A mixer in accordance with claim 1, wherein said mixing worm has a hollow worm shaft with a lower end, said mixing worm having blades along its length, at least a portion of said blades adjacent said lower end having triangularly shaped hollow chambers with upper sides and lower sides, said upper side of each hollow chamber being constructed of sheet steel, said lower side thereof being constructed of tempered metal, said hollow worm shaft including a gas connection at said lower end and gas feed openings therealong.

* * * * *